United States Patent [19]

Kertis et al.

[11] Patent Number: 4,820,967

[45] Date of Patent: Apr. 11, 1989

[54] BICMOS VOLTAGE REFERENCE GENERATOR

[75] Inventors: Robert A. Kertis; Douglas D. Smith, both of Puyallup, Wash.

[73] Assignee: National Semiconductor Corporation, Santa Clara, Calif.

[21] Appl. No.: 151,348

[22] Filed: Feb. 2, 1988

[51] Int. Cl.[4] ..... G05F 3/16

[52] U.S. Cl. ..... 323/314; 323/315

[58] Field of Search ..... 323/315, 313, 314

[56] References Cited

U.S. PATENT DOCUMENTS

| | | | |
|---|---|---|---|
| 4,274,061 | 6/1981 | Kraemer | 323/315 |
| 4,280,090 | 7/1981 | Lindberg | 323/315 |
| 4,342,926 | 8/1982 | Whatley | 323/315 |
| 4,359,680 | 11/1982 | Hellums et al. | 323/315 |
| 4,450,367 | 5/1984 | Whatley | 323/315 |
| 4,525,663 | 6/1985 | Henry | 323/315 |

*Primary Examiner*—Patrick R. Salce
*Assistant Examiner*—Jeffrey Sterrett
*Attorney, Agent, or Firm*—Lee Patch; Robert C. Colwell; Jonathan A. Small

[57] ABSTRACT

A BiCMOS voltage reference generator circuit generates and maintains a reference voltage within 3 mV over an 80° C. temperture range and over a 1 volt change in power supply level. The circuit uses feedback from the output of the reference voltage generator to the current source supplying current to the voltage reference generator. This feedback increases the effective output impedance of the current source, making the reference voltage output substantially independent of power supply variations. The circuit operates with power supply differential as low as about 3 volts, and preferably is fabricated from bipolar transistors and MOS transistors on the same chip.

10 Claims, 1 Drawing Sheet

BICMOS VOLTAGE REFERENCE GENERATOR

BACKGROUND OF THE INVENTION

1. Field of the Invention

The invention relates generally to electronic integrated circuits, and more particularly, to a BiCMOS voltage reference generator for establishing and maintaining a reference voltage.

2. Description of the Prior Art

Prior art voltage reference generators generally have a power supply and utilize a constant current source which generates a reference voltage output signal. It is known that the reference voltage output signal can be made substantially independent of power supply variations by providing a constant current source with a high output impedance. Prior art constant current generators, however, require a power supply differential of 5 volts or more to provide high output impedance. Furthermore, the best voltage reference generators constructed with prior art techniques exhibit 20 mV change on the reference voltage output per 1 volt change in power supply, and often require power supply voltages of at least 5 volts.

SUMMARY OF THE INVENTION

The present invention provides a BiCMOS voltage reference generator capable of operating from power supplies having a small voltage differential. The circuit of the present invention establishes and maintains a reference voltage with high accuracy over large temperature ranges and power supply variations.

The performance of the circuit of the present invention, as well as its ability to operate from low power supply levels, is achieved through a feedback configuration. An inner loop reference voltage generator is connected to the power supplies and has a current node that is connected to a constant current source. The current source is connected by feedback to the reference voltage output of the inner loop reference voltage generator.

The present invention uses a converter to convert the reference voltage to a reference current directly proportional to the reference voltage. By connecting the converter to a first current source the current flowing in the first current source will equal the reference current. A second current source is connected to the first current source in a "current mirror" configuration. Thus, the current flowing in the second current source is also directly proportional to the reference current, and therefore directly proportional to the reference voltage.

The feedback loop described above causes the second current source to have an extremely high output impedance. This high output impedance allows the reference voltage to be substantially independent of power supply variations. The use of the reference voltage output to establish a reference current also allows the second current source and inner loop reference voltage generator to operate from low power supply differentials.

Because the feedback configuration described above is potentially bistable during power transitions a third current source draws a trickle current in addition to the first current source to assure that output Vref is the proper level. Other features and advantages of the invention will appear from the accompanying drawings and the detailed description that follow, wherein the preferred embodiment is set forth in detail.

DETAILED DESCRIPTION OF THE PREFERRED EMBODIMENTS

Figure 1:
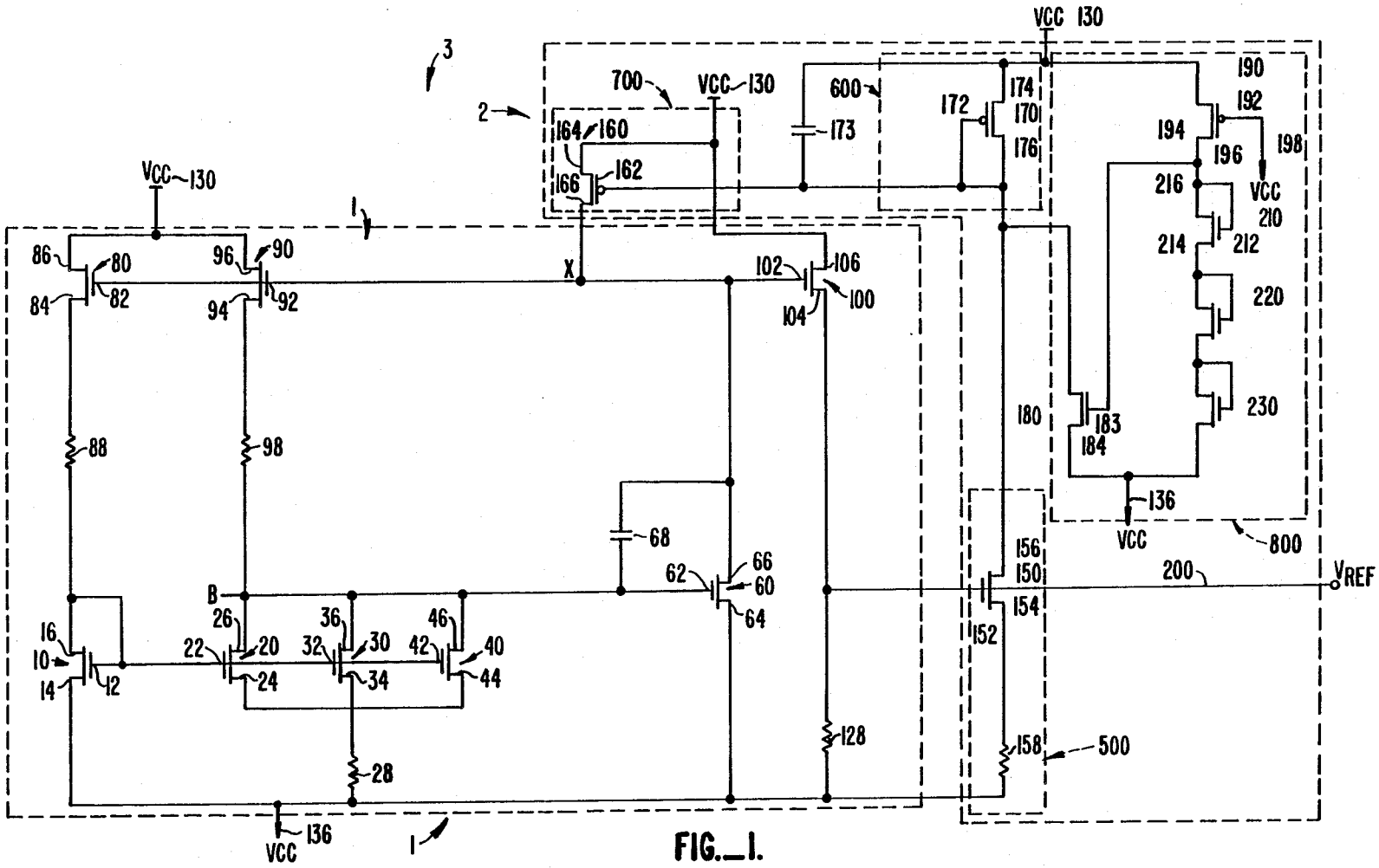
FIG. 1 is a schematic of the preferred embodiment, according to the present invention.
Figure 1:
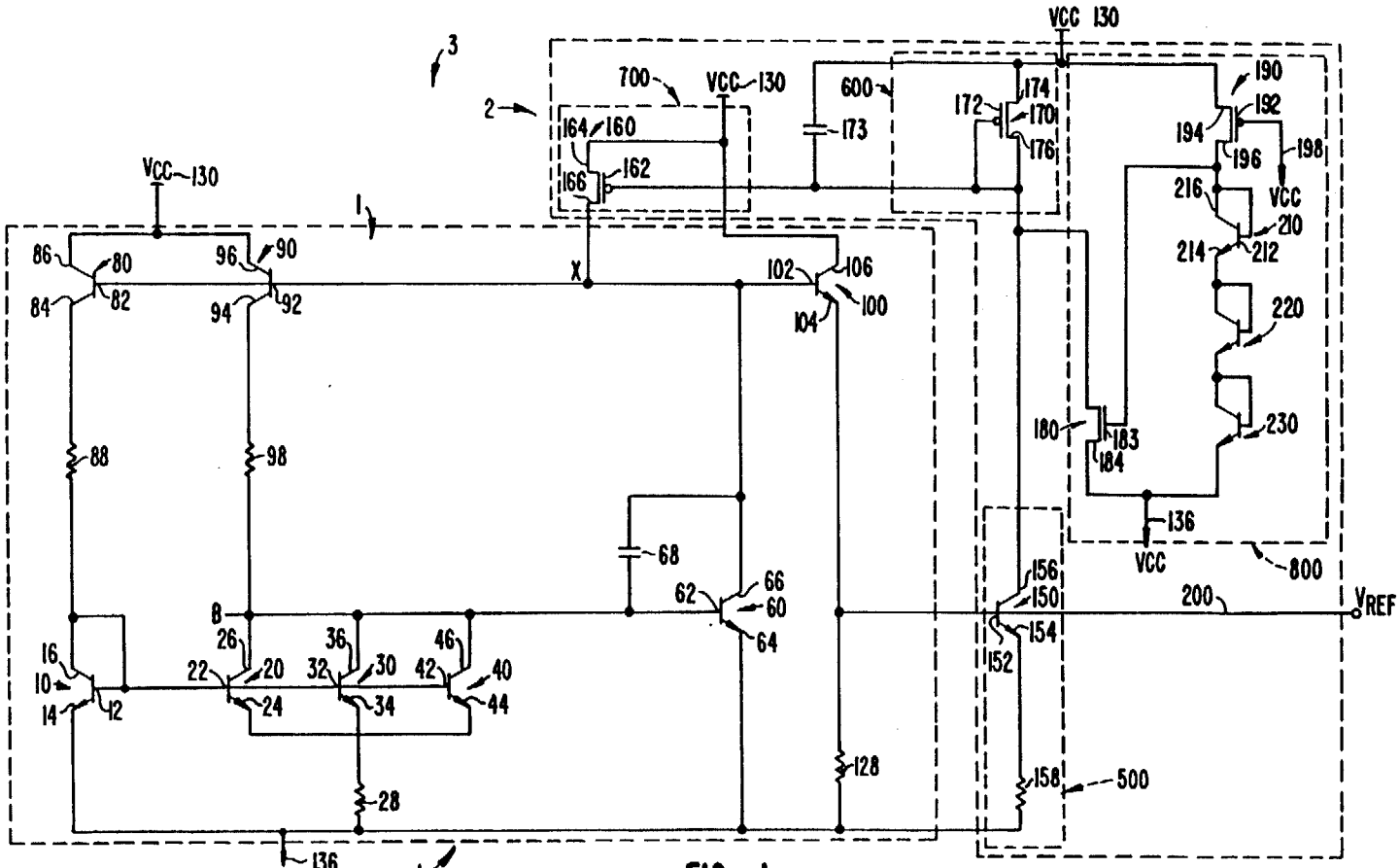

The preferred embodiment of the present invention is shown in FIG. 1. An inner loop voltage reference generator 1 receives an upper (positive) power supply Vcc on line 130, a lower (negative) power supply Vee on line 136, and a constant current at node x. In response, the inner loop generator 1 supplies a reference voltage, Vref, on line 200.

The reference voltage, Vref on line 200, is converted to a directly proportional reference current, Iref, by a converter 500. A first current source 600 is connected in series with Vref to Iref converter 500. This series connection requires the current supplied by first current source 600 to be the same as the reference current, Iref. A second current source 700 is connected to first current source 600 as a current mirror. The second current source 700 supplies a constant current directly proportional to Iref, and thus to Vref.

The feedback configuration described above causes the second current source to have an extremely high output impedance, thereby making the reference voltage, Vref, substantially independent of power supply variations. The use of a reference voltage to establish the reference current Iref allows the second current source 700 and reference voltage generator 1 to operate from low power supply differentials.

The output voltage Vref on line 200 equals the base-emitter drop of transistor 60 plus the voltage drop across resistor 98 and the base-emitter voltage drop of transistor 90 less the base-emitter voltage drop of transistor 100. Because the base-emitter voltage drops of transistors 90 and 100 are substantially equal, Vref will be the base-emitter voltage of transistor 60 plus the voltage drop across resistor 98.

The voltage drop across resistor 98 is the impedance of resistor 98 multiplied by the emitter current of transistor 90. The emitter current of transistor 90 is the sum of the collector currents from transistors 20, 30 and 40, added to a negligible amount of current in base 62 of transistor 60.

The collector currents through transistors 20, 30 and 40 are determined by the voltage drop across resistor 28, which is determined by the differential in base-emitter voltage between transistor 10 and parallel-connected transistors 20, 30 and 40. Transistors 20, 30 and 40 are parallel-connected to create different current densities and different base-emitter voltage drops in these three transistors compared to transistor 10. The base-emitter differential stabilizes the voltage drop across resistor 28. In turn, the constant voltage drop across resistor 28 establishes a constant current flow through resistor 98, and a constant voltage drop across resistor 98. The impedance of resistor 98 is made larger than the impedance of resistor 28 to provide voltage gain, and to allow Vref to be set to a desired value. Vref on line 200 is established at approximately 1.25 volts more positive than lower power supply Vee on line 136.

Transistor 80 and resistor 88 bias transistor 10 to establish a base-emitter drop. Resistor 128 provides a load for transistor 100, while capacitor 68 compensates the circuit against unwanted oscillation.

The inner loop voltage reference generator circuit described above establishes and maintains a stable voltage Vref on line 200 over wide temperature variation. If, for example, Vref to decrease, the voltage Vx at base 102 of transistor 100 decreases causing the voltage at emitter 94 to decrease. Thus, the current flowing into base 62 decreases and transistor 60 tends to turn off. As transistor 60 begins to turn off, voltage Vx at collector 66 rises, forcing emitter 104 and Vref to rise, thus compensating for the decrease in Vref. Capacitor 68 connected across transistor 60, and capacitor 173 connected across transistor 170 reduce frequency response of the circuit to assure oscillation-free operation.

The circuit described compensates for temperature change by balancing the negative temperature coefficient of the base-emitter voltage from transistor 60 with the positive temperature coefficient of the voltage drop across resistor 98. The circuit, however, is sensitive to changes in Vcc. Changes in Vcc cause the potential at node x to change. If the potential at node x changes, the bias of the transistors in the inner loop voltage reference generator circuit 1 change, and as a result, Vref changes.

The remainder of the circuitry shown in FIG. 1 makes inner loop voltage reference generator 1 less sensitive to changes in Vcc. This circuitry includes: a Vref to Iref converter 500, a first current source 600, a second current source 700, and a trickle current source 800.

Vref to Iref converter 500 includes converting transistor 150 and resistor 158. Converting transistor 150 has its base connected to Vref on line 200 and its emitter 154 connected to a first terminal of resistor 158. The second terminal on resistor 158 connects to a lower power supply Vee on line 136. Collector 156 of transistor 150 is connected to gate 172 and drain 176 of PMOS transistor 170. The reference voltage Vref applied to base 152 establishes a voltage Vr across resistor 158 equal to (Vref−Vbe−Vee) where Vbe is the base emitter drop of transistor 150. The voltage drop Vr produces a current flow, Iref, through resistor pg,7 158 and transistor 150. Because Iref=Vr/R158, Iref is directly proportional to Vref. The resistance of resistor 158 is selected to provide a suitable value of Iref as dictated by the requirements for current at node x and the characteristics of transistors 170 and 160.

First current source 600 includes PMOS transistor 170. Neglecting for the moment transistor 180, all of the current flowing through transistor 150 must flow through PMOS transistor 170. Therefore, the current through transistor 170 will be Iref.

Second current source 700 includes PMOS transistor 160. PMOS transistors 160 and 170 are similar devices and are connected together as a current mirror. Gate 162 of transistor 160 is connected to gate 172 of transistor 170, and source 164 of transistor 160 is connected to source 174 of transistor 170 and to power supply Vcc on line 130. Thus, the gate-source voltage of transistors 160 and 170 will be equal, and the current flowing through PMOS transistor 160 will be directly proportional to the current flowing through PMOS transistor 170, and consequently directly proportional to Iref. Of course, the sizes of transistors 160 and 170 may be scaled such that current supplied by second current source 700 is less than, equal to, or greater than Iref.

Trickle current source 800 prevents circuit 1 from providing a stable output voltage equal to Vee, rather than the desired Vref. Trickle current source 800 pulls a minuscule amount of current from first current source 600, thereby forcing the first current source 600 to provide a non-zero amount of current. As long as current source 600 provides any current, Iref will be non-zero and therefore Vref will be non-zero.

In trickle current source 800, transistors 210, 220 and 230 are series-connected as diodes to provide approximately 2.1 volts gate-source to transistor 180. Transistor 180 will be slightly on with approximately 2.1 volts across gate 182 and source 184. PMOS transistor 190 has gate 192 connected to lower power supply Vee on line 136, source 194 connected to the upper power supply Vcc on line 130, and drain 196 connected to gate 182 of transistor 180. Transistor 190 will be on when its gate-source voltage exceeds a PMOS threshold. When power is first applied, transistor 190 supplies current to the diode series 210, 220, 230. As a result, first current source transistor 170 delivers a trickle current into drain 186 of NMOS transistor 180. Therefore, Iref is non-zero, and Vref is greater than Vee.

In operation, as Vref varies, Iref will vary until the desired level of Vref is again attained. Current flowing from PMOS transistor 160 into node x is substantially independent of the voltage at node x. PMOS transistor 160 acts as a constant current source with extremely high output impedance. The result is an improved voltage reference generator exhibiting 3 mV/volt regulation over 80° C. temperature changes. This performance is a 7-fold improvement over prior art voltage reference generators.

In the above description implementation standing of the voltage reference generator disclosed herein. These details should not be interpreted as limiting the invention. For example, the circuit of the present invention may be used to improve the performance of other circuits requiring a high impedance current source. Other types of transistors may be employed, for example, an NMOS transistor could be used and resistor 158 deleted. An operational amplifier rather than a transistor could be used to convert the voltage reference output to a reference current. Of course, different polarity semiconductor devices may be used in a complementary configuration to produce an output voltage referenced to the upper power supply rather than to the lower supply. The scope of the invention is set forth in the appended claims.

We claim:

1. A reference voltage generator for generating a stable voltage over variations of source voltage and temperature of the type including an inner loop reference voltage generator connected to receive feedback current from a current mirror, comprising:

a inner loop reference voltage generator connected to receive a source voltage, including means for generating an inner loop reference voltage from said source voltage, means for generating a reference voltage form said inner loop reference voltage and a feedback current, and further including a feedback current receiving node for receiving said feedback current from a current mirror; and a current mirror connected to receive said reference voltage for generating from said reference voltage a feedback current, said current mirror circuit connected to said feedback current receiving node for outputting to said inner loop reference voltage generator said feedback current.

2. The reference voltage generator of claim 1, wherein said inner loop reference voltage generator includes first and second transistors having a net base-emitter voltage difference, converter means for converting said base-emitter voltage difference into a reference current, and current-controlling means for controlling said reference current such that said reference current is constant over variations in source voltage and temperature.

3. The reference voltage generator of claim 2, wherein said inner loop reference voltage generator includes means for scaling said base-emitter voltage difference, and further includes a third transistor connected to said first and second transistors such that the base-emitter voltage of said third transistor is added to the scaled base-emitter voltage difference to produce thereby said reference voltage.

4. The reference voltage generator of claim 1, wherein said current mirror includes first and second current sources connected so as to present to said feedback current receiving node a high impedance current proportional to said reference voltage.

5. The reference voltage generator of claim 4, wherein said first and second current sources are CMOS-type semiconductor devices.

6. The reference voltage generator of claim 4, further including means for reducing the frequency response of the reference voltage generator to prevent oscillation.

7. The reference voltage generator of claim 6, wherein said means for reducing comprises a capacitor connected across said first current source.

8. The reference voltage generator of claim 1, further including means for preventing the reference voltage from remaining at other than a preselected voltage when power to the reference voltage generator is applied.

9. The reference voltage generator of claim 8, wherein said means for preventing the reference voltage from remaining at other than a preselected voltage includes a third current source connected to said current mirror to allow a trickle current to flow through the current mirror.

10. A reference voltage generator for generating a stable voltage over variations of source voltage and temperature of the type including an inner loop reference voltage generator connected to receive feedback current from a current mirror, comprising:

an inner loop reference voltage generator connected to receive a source voltage, including means for generating an inner loop reference voltage from said source voltage and means for generating a reference voltage form said inner loop reference voltage and a feedback current, and further including a feedback current receiving node for receiving said feedback current from a current mirror;

a current mirror connected to receive said reference voltage including first and second current sources, for generating from said reference voltage a feedback current, and further connected so as to present to said feedback current receiving node a high impedance current proportional to said reference voltage;

means for preventing the reference voltage from remaining at other than a preselected voltage including a third current source connected to said current mirror to allow a trickle current to flow through the current mirror; and a capacitor connected across the first current source for reducing the frequency response of the reference voltage generator to prevent oscillation.

* * * * *

UNITED STATES PATENT AND TRADEMARK OFFICE

CERTIFICATE OF CORRECTION

PATENT NO. : 4,820,967

DATED : April 11, 1989

INVENTOR(S) : Robert A. Kertis and Douglas D. Smith

It is certified that error appears in the above—identified patent and that said Letters Patent is hereby corrected as shown below:

The title page should be deleted to appear as per attached title page

Figure 1 should be deleted to appear as per attached sheet.

Signed and Sealed this

Seventh Day of August, 1990

*Attest:*

HARRY F. MANBECK, JR.

*Attesting Officer*

*Commissioner of Patents and Trademarks*

United States Patent [19]

Kertis et al.

[11] Patent Number: 4,820,967

[45] Date of Patent: Apr. 11, 1989

[54] BICMOS VOLTAGE REFERENCE GENERATOR

[75] Inventors: Robert A. Kertis; Douglas D. Smith, both of Puyallup, Wash.

[73] Assignee: National Semiconductor Corporation, Santa Clara, Calif.

[21] Appl. No.: 151,348

[22] Filed: Feb. 2, 1988

[51] Int. Cl.[4] ..... G05F 3/16

[52] U.S. Cl. ..... 323/314; 323/315

[58] Field of Search ..... 323/315, 313, 314

[56] References Cited

U.S. PATENT DOCUMENTS

| | | | |
|---|---|---|---|
| 4,274,061 | 6/1981 | Kraemer | 323/315 |
| 4,280,090 | 7/1981 | Lindberg | 323/315 |
| 4,342,926 | 8/1982 | Whatley | 323/315 |
| 4,359,680 | 11/1982 | Hellums et al. | 323/315 |
| 4,450,367 | 5/1984 | Whatley | 323/315 |
| 4,525,663 | 6/1985 | Henry | 323/315 |

*Primary Examiner*—Patrick R. Salce
*Assistant Examiner*—Jeffrey Sterrett
*Attorney, Agent, or Firm*—Lee Patch; Robert C. Colwell; Jonathan A. Small

[57] ABSTRACT

A BiCMOS voltage reference generator circuit generates and maintains a reference voltage within 3 mV over an 80° C. temperture range and over a 1 volt change in power supply level. The circuit uses feedback from the output of the reference voltage generator to the current source supplying current to the voltage reference generator. This feedback increases the effective output impedance of the current source, making the reference voltage output substantially independent of power supply variations. The circuit operates with power supply differential as low as about 3 volts, and preferably is fabricated from bipolar transistors and MOS transistors on the same chip.

10 Claims, 1 Drawing Sheet

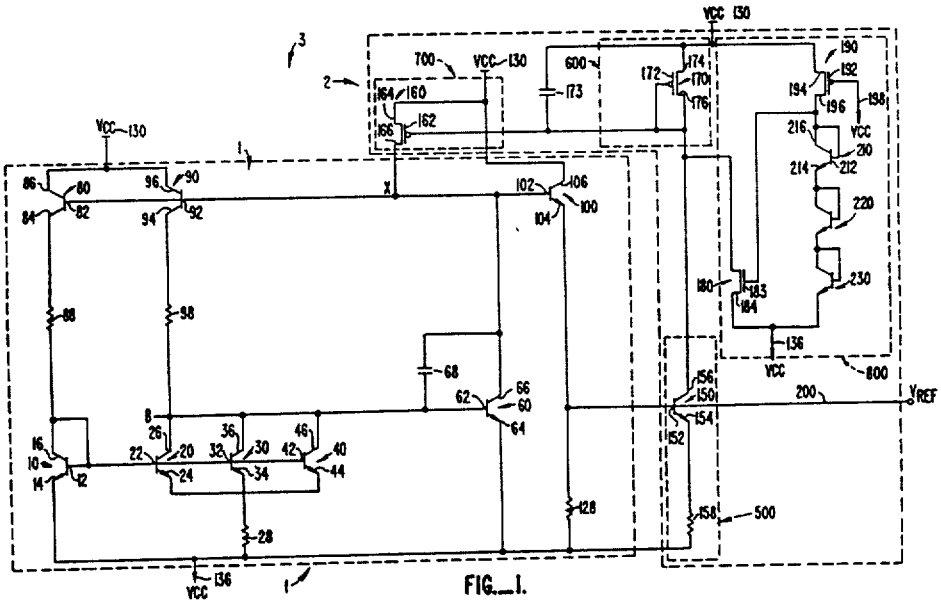

FIG._1.